US012055147B2

(12) United States Patent
Cui

(10) Patent No.: US 12,055,147 B2
(45) Date of Patent: Aug. 6, 2024

(54) FAN

(71) Applicants: GD MIDEA ENVIRONMENT APPLIANCES MFG CO., LTD., Zhongshan (CN); MIDEA GROUP CO., LTD., Foshan (CN)

(72) Inventor: Shiqiang Cui, Zhongshan (CN)

(73) Assignees: GD MIDEA ENVIRONMENT APPLIANCES MFG CO., LTD., Zhongshang (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 17/772,807

(22) PCT Filed: Jan. 9, 2020

(86) PCT No.: PCT/CN2020/071055
§ 371 (c)(1),
(2) Date: Jun. 17, 2022

(87) PCT Pub. No.: WO2021/128487
PCT Pub. Date: Jul. 1, 2021

(65) Prior Publication Data

US 2022/0364566 A1 Nov. 17, 2022

(30) Foreign Application Priority Data

Dec. 25, 2019 (CN) ..... 201922365162.6

(51) Int. Cl.
*F04D 19/00* (2006.01)
*F04D 29/52* (2006.01)
*F04D 29/64* (2006.01)

(52) U.S. Cl.
CPC ..... *F04D 19/002* (2013.01); *F04D 29/524* (2013.01); *F04D 29/644* (2013.01)

(58) Field of Classification Search
CPC .... F04D 19/002; F04D 29/524; F04D 29/644; F04D 29/646; F04D 29/668;
(Continued)

(56) References Cited

U.S. PATENT DOCUMENTS 4,732,539 A 3/1988 Shin-Chin
6,533,548 B1 3/2003 Wang et al.

FOREIGN PATENT DOCUMENTS

CN 204628038 U 9/2015
CN 204663952 U 9/2015
(Continued)

OTHER PUBLICATIONS

The World Intellectual Property Organization (WIPO) International Search Report for PCT/CN2020/071055 Sep. 29, 2020 7 Pages.
(Continued)

*Primary Examiner* — Aaron R Eastman
(74) *Attorney, Agent, or Firm* — Anova Law Group, PLLC

(57) ABSTRACT

A fan includes a column assembly, a fan head, a hinge assembly, and a support structure connected to the fan head and the column assembly. The hinge assembly includes a first connection member and a second connection member which are hinge-connected to each other. The first connection member is connected to the column assembly, and the second connection member is connected to the fan head. The fan head is configured to rotate around the support structure, and an axis around which the fan head rotates relative to the support structure coincides with an axis around which the first connection member and the second connection member rotate relative to each other.

20 Claims, 2 Drawing Sheets

(58) Field of Classification Search
CPC ..... F04D 25/105; F04D 25/10; F04D 27/00; F04D 29/002; F05D 2210/12
See application file for complete search history.

(56) References Cited

FOREIGN PATENT DOCUMENTS

| | | | |
|---|---|---|---|
| CN | 206190578 | U | 5/2017 |
| CN | 108869376 | A | 11/2018 |
| CN | 109779937 | A | 5/2019 |
| CN | 209458165 | U | 10/2019 |
| JP | S57021894 | U | 2/1982 |
| JP | 2012241779 | A | 12/2012 |
| JP | 2015042878 | A | 3/2015 |
| JP | 3215502 | U | 3/2018 |
| JP | 2018178789 | A | 11/2018 |

OTHER PUBLICATIONS

Japan Patent Office (JPO) The Office Action For JP Application No. 2022-525198 May 8, 2023 12 Pages (Translation Included).
Japan Patent Office (JPO) The Notice of Reasons for Refusal For JP Application No. 2022-525198 Nov. 14, 2023 8 Pages (Translation Included).

FAN

CROSS-REFERENCE TO RELATED APPLICATIONS

This application is a National Stage Entry under 35 U.S.C. § 371 of International Application No. PCT/CN2020/071055, filed on Jan. 9, 2020, which claims priority to Chinese Patent Application No. 201922365162.6 filed with China National Intellectual Property Administration on Dec. 25, 2019 and entitled "Fan," the entire contents of both of which are incorporated herein by reference.

This application claims priority to Chinese Patent Application No. 201922365162.6 filed with China National Intellectual Property Administration on Dec. 25, 2019 and entitled "Fan," the entire content of which is incorporated herein by reference.

FIELD

The present disclosure relates to the technical field of household appliances, and particularly relates to a fan.

BACKGROUND

At present, as shown in FIG. 1, for the fan 100' in the related art, the rotation of the fan head 104' relative to the column 102' is realized by means of a semicircular arc-shaped pivot point, resulting in poor stability of the fan head 104'.

SUMMARY

The present disclosure aims to solve at least one of the technical problems existing in the existing technologies or the related art.

To this end, a first aspect of the present disclosure provides a fan.

In view of this, the present disclosure proposes a fan, comprising: a column assembly; a fan head; a hinge assembly comprising a first connection member and a second connection member which are hinge-connected to each other, the first connection member being connected to the column assembly, and the second connection member being connected to the fan head; and a support structure, connected to the fan head and the column assembly, wherein the fan head is adapted to rotate around the support structure, and an axis around which the fan head rotates relative to the support structure coincides with an axis around which the first connection member and the second connection member rotate relative to each other.

The fan provided in the present disclosure comprises a column assembly and a fan head, the fan head and the column assembly are connected by a hinge assembly and a support structure, wherein a first connection member and a second connection member of the hinge assembly are hinge-connected to each other, i.e., the first connection member and the second connection member can rotate relative to each other, the fan head is adapted to rotate around the support structure, and an axis around which the fan head rotates around the support structure coincides with an axis around which the first connection member and the second connection member rotate relative to each other, so that the fan head can rotate around the axis around which the first connection member and the second connection member rotate relative to each other, i.e., the fan head can rotate around the column assembly, thereby realizing adjustment of an air outlet angle of the fan head. Further, the support structure connects the fan head and the column assembly, which improves the reliability of connection between the fan head and the column assembly, while eliminating the need to rotate the fan through a semicircular arc-shaped pivot point in the related art, thus enabling the fan to have a better appearance and higher stability, and improving use experience of the user.

The fan provided according to the present disclosure as described above may also have the following additional technical features.

In the above embodiment, further, the axis around which the first connection member and the second connection member rotate relative to each other is perpendicular to a length direction of the column assembly.

In this embodiment, the axis around which the first connection member and the second connection member rotate relative to each other is perpendicular to the length direction of the column assembly, thus realizing adjustment of an angle of depression and an angle of elevation of the fan head, thereby expanding an air outlet area of the fan.

In any of the above embodiments, further, the fan further comprises: a limit member provided at the fan head and/or the column assembly, wherein the limit member is adapted to limit rotation of the fan head between a first position and a second position.

In this embodiment, the fan further comprises a limit member, and by providing the limit member, the range of rotation of the fan head can be limited, such that the fan head rotates between the first position and the second position.

In any of the above embodiments, further, an angle by which the fan head rotates from a horizontal position towards below the fan to the first position is greater than or equal to 0° and smaller than or equal to 6°, and an angle by which the fan head rotates from the horizontal position towards above the fan to the second position is greater than or equal to 0° and smaller than or equal to 90°, wherein the horizontal position is between the first position and the second position, the fan head comprises a drive shaft and fan blades connected to the drive shaft, and when the fan head is located at the horizontal position, an axis of the drive shaft is perpendicular to the length direction of the column assembly.

In this embodiment, the horizontal position is between the first position and the second position, and the fan head can move from the horizontal position to the first position and the second position respectively. When the fan head is in the horizontal position, the axis of the drive shaft is perpendicular to the length direction of the column assembly. That is, when the fan head is in the horizontal position, the air outlet direction of the fan is horizontal or approximately horizontal. The adjustment of the angle of depression and the angle of elevation of the fan head can be realized through the hinge assembly and the support structure. The angle by which the fan head rotates from the horizontal position towards below the fan to the first position is greater than or equal to 0° and smaller than or equal to 6°, i.e., the angle of depression of the fan head moving downward from the horizontal position is greater than or equal to 0° and smaller than or equal to 6°; and the angle by which the fan head rotates from the horizontal position towards above the fan to the second position is greater than or equal to 0° and smaller than or equal to 90°, i.e., the angle of elevation of the fan head moving upward from the horizontal position is greater than or equal to 0° and smaller than or equal to 90°. That is, the fan head can achieve an angle of depression of 6° and an angle of elevation of 90°, which expands the blowing range of the fan.

In any of the above embodiments, further, the limit member on the fan head is arranged at one side of the fan head close to the support structure, and the limit member on the column assembly is arranged at one side of the column assembly close to the support structure.

In this embodiment, the limit member is arranged close to the support structure, so that the angle of rotation of the hinge assembly can be limited at one side of the support structure.

In any of the above embodiments, further, the hinge assembly further comprises: a rotation shaft at which the first connection member and the second connection member are arranged, the second connection member being adapted to rotate around the rotation shaft, wherein in an axis direction of the rotation shaft, the second connection member is arranged at one side of the first connection member; and an adjustment member connected to the rotation shaft and adapted to press the second connection member in the axis direction of the rotation shaft.

In this embodiment, the hinge assembly further comprises a rotation shaft and an adjustment member, and in the axis direction of the rotation shaft, the second connection member is located at one side of the first connection member, that is, the second connection member is located at the outer side of the first connection member, so that the first connection member and the second connection member can be sequentially mounted at the rotation shaft, which improves the assembly efficiency of the product and enhances the reliability of the product. Moreover, the first connection member can avoid the second connection member when the second connection member rotates, thus enabling the second connection member to have a greater angle of rotation to meet different use scenarios. The hinge assembly further comprises an adjustment member connected to the rotation shaft and adapted to press the second connection member in the axis direction of the rotation shaft, thus adjusting the axial pressure on the second connection member to improve the reliability of the hinge assembly.

In any of the above embodiments, further, the adjustment member comprises: a tightening member located at one end of the rotation shaft, the rotation shaft and the tightening member being each provided with a threaded structure, and the tightening member and the rotation shaft being threadedly connected by the threaded structure, wherein another end of the rotation shaft is further provided with a limiting structure, and the first connection member and the second connection member are located between the limiting structure and the tightening member.

In this embodiment, the adjustment member comprises a tightening member, the rotation shaft is provided with a tightening member at one end and a limiting structure at another end, the first connection member and the second connection member are provided between the limiting structure and the tightening member, and the squeezing force applied to the second connection member can be adjusted by the tightening member, wherein both the tightening member and the rotation shaft are provided with a threaded structure, and the tightening member and the rotation shaft are threadedly connected by the threaded structure, so that the squeezing force applied by the tightening member to the second connection member is adjustable. Moreover, threaded connection is highly reliable, and when the tightening member is rotated to be removed from the rotation shaft, the parts on the rotation shaft can be easily removed and replaced.

In any of the above embodiments, further, the adjustment member further comprises: a damping member connected to the rotation shaft, the damping member being arranged between the first connection member and the tightening member, and/or between the second connection member and the first connection member.

In this embodiment, the adjustment member further comprises a damping member connected to the rotation shaft. The damping member can increase the resistance to the rotation of the second connection member, so that the friction generated by the rotation of the second connection member is increased, and the force required to rotate the second connection member will also increase, thereby improving the stability of the hinge assembly. The damping member may be selectively arranged between the first connection member and the tightening member and between the second connection member and the first connection member.

In any of the above embodiments, further, the adjustment member further comprises: a spacer connected to the rotation shaft, the spacer being arranged between the second connection member and the limiting structure, and/or between the first connection member and the second connection member, and/or between the first connection member and the tightening member.

In this embodiment, the adjustment member further comprises a spacer which may be provided between two structures to improve the stability of connection. The spacer is arranged between the second connection member and the limiting structure, and/or between the second connection member and the first connection member, and/or between the first connection member and the tightening member. Moreover, the position and number of spacers and damping members may be set at will in the present disclosure, while the position and number of spacers are limited by the distance between two connection walls in the related art.

In any of the above embodiments, further, in the axis direction of the rotation shaft, at least a portion of the rotation shaft is formed with a limit surface; the spacer is provided with a through hole, and a shape of a cross section of the through hole matches a shape of a cross section of a portion of the rotation shaft provided with the limit surface.

In this embodiment, in the axis direction of the rotation shaft, the rotation shaft is formed with a limit surface, and the shape of the section of the through hole of the spacer is adapted to the shape of the portion of the rotation shaft provided with the limit surface, so that the spacer cannot be rotated along the rotation shaft, thus improving the stability of the hinge assembly.

In any of the above embodiments, further, the number of limit surfaces is at least two, and in a circumferential direction of the axis of the rotation shaft, the at least two limit surfaces are provided opposite each other.

In this embodiment, in the circumferential direction of the axis of the rotation shaft, at least two limit surfaces are provided opposite each other, which improves the limiting effect of the limit surfaces.

In any of the above embodiments, further, the damping member is a resilient pad.

In this embodiment, the damping member is a resilient pad, thus making it possible to adjust the force required to rotate the second connection member.

In any of the above embodiments, further, the support structure is ring-shaped.

In this embodiment, the support structure is ring-shaped, thus facilitating the rotation of the fan head around the support structure, and further, the hollow portion of the ring-shaped structure also allows wires to pass through, making the wiring of the fan more reasonable and saving the space occupied by the fan.

In any of the above embodiments, further, the support structure comprises a rubber support structure.

In this embodiment, the support structure comprises a rubber support structure. The rubber support structure has a certain friction and has a certain wear resistance, and thus can improve the stability of the fan head when rotating.

In any of the above embodiments, further, the column assembly comprises: a column; a first mounting member provided at the column, at least a portion of the support structure being accommodated in the first mounting member; and a second mounting member, at least a portion of the hinge assembly being accommodated in the second mounting member, wherein the first mounting member and the second mounting member are located at two opposite sides of the column.

In this embodiment, the column assembly comprises a column, a first mounting member and a second mounting member, wherein the support structure is provided in the first mounting member, the support structure is supported and pre-mounted by the first mounting member, the hinge assembly is accommodated in the second mounting member, and the hinge assembly can be pre-mounted by the second mounting member, i.e., at the time of connecting the hinge assembly to the column assembly, it is feasible to first place the hinge assembly in the second mounting member, thus facilitating the mounting of the hinge assembly.

The first mounting member and the second mounting member are located at two opposite sides of the column, which improves the strength of the connection between the fan head and the column assembly.

In any of the above embodiments, further, the fan head comprises: a housing, a first connection member being connected to the housing, and a motor of the fan head being located in the housing; a first limit part provided at the housing, the first limit part being connected to the support structure, and the first limit part being adapted to rotate around the support structure; and a second limit part provided at the housing, the second limit part being connected to the column, and the support structure being clamped between the second limit part and the column, wherein the fan further comprises a fixation member, and the second limit part is hinged to the column through the fixation member.

In this embodiment, the fan head comprises a housing, a first limit part, and a second limit part, wherein the motor of the fan is provided in the housing, and the drive shaft of the motor drives the fan blades to rotate to exhaust air to the environment. The first limit part is connected to the support structure, the second limit part is connected to the column, and the support structure is clamped between the column and the second limit part, thus limiting the support structure.

In any of the above embodiments, further, the first limit part comprises a limiting groove, the support structure being engaged in the limiting groove.

In this embodiment, the first limit part comprises a limiting groove, and engaging the support structure in the limiting groove improves the connection strength on the one hand, and facilitates the detachment of the support structure on the other hand.

In any of the above embodiments, further, the second limit part is provided with a wire passing member, wherein the fan further comprises a connection wire, and the connection wire is connected to the fan head from the column assembly through the wire passing member.

In this embodiment, the second limit part is hollowed out, so that wires can be passed through the hollowed-out wire passing member, and therefore the adjustment of the angle of depression and the angle of elevation of the fan head will not be limited by the connection wire.

In any of the above embodiments, further, an outer side wall of the second limiting section is arc-shaped.

In this embodiment, the outer side wall of the second limit part is arc-shaped, so as to be adapted to the shape of the support structure, ensuring the clamping effect on the support structure, and also ensuring the reliability of the rotation of the fan head.

Additional aspects and advantages of the present disclosure will become apparent in the following description, or are understood by the practice of the present disclosure.

BRIEF DESCRIPTION OF THE DRAWINGS

The above and/or additional aspects and advantages of the present disclosure will become apparent and readily understood from the following description of embodiments in conjunction with the drawings.

Figure 1:
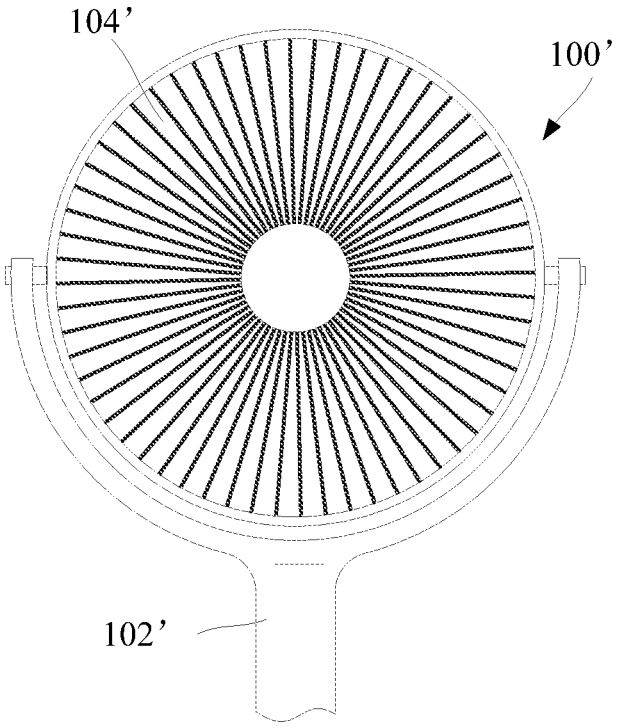
FIG. 1 is a schematic diagram of a structure of a fan in the related art.

The correspondence between the reference signs and component names in FIG. 1 is as follows:

100' fan, 102' column, and 104' fan head.

Figure 2:
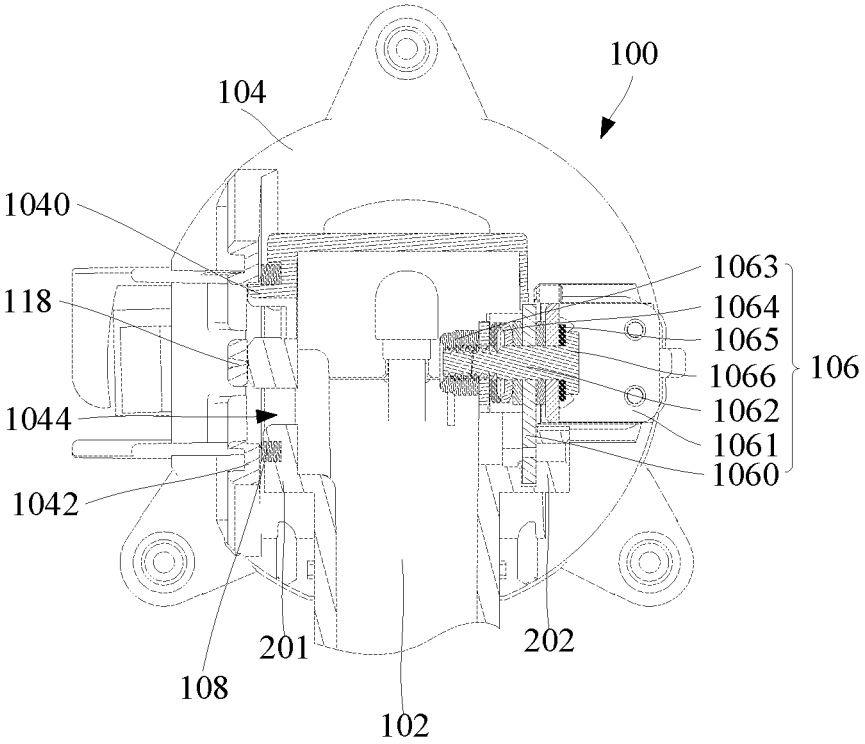

FIG. 2 is a schematic structural diagram of a part of a fan in an embodiment of the present disclosure.

Figure 3:
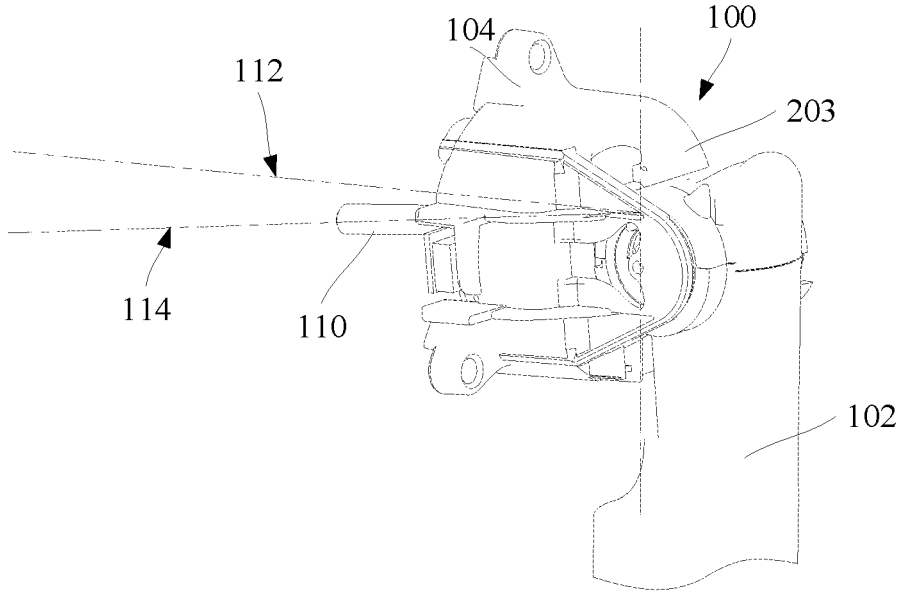

FIG. 3 is a schematic structural diagram of another part of the fan in an embodiment of the present disclosure.

Figure 4:
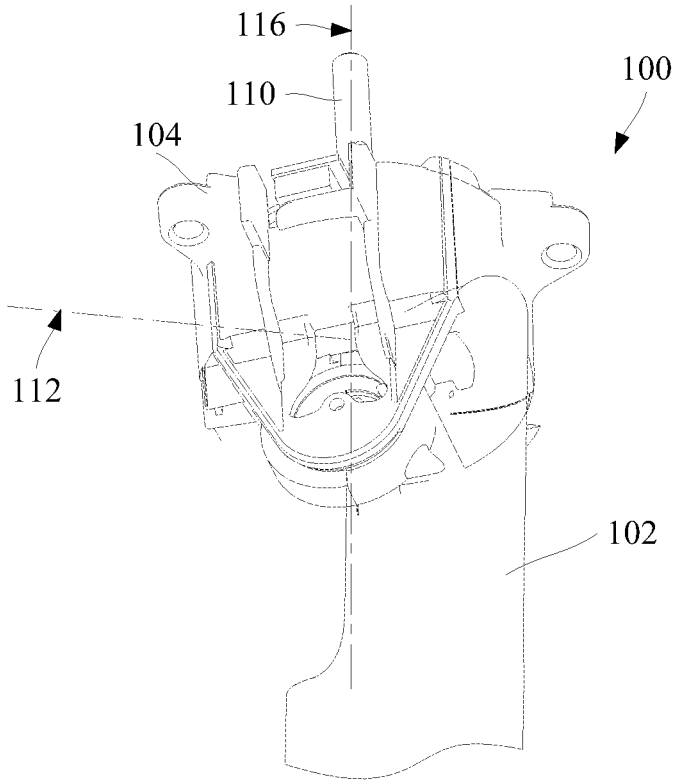

FIG. 4 is a schematic structural diagram of a further part of the fan in an embodiment of the present disclosure.

The correspondence between the reference signs and component names in FIGS. 2 to 4 is as follows:

100 fan, 102 column assembly, 104 fan head, 1040 first limit part, 1042 second limit part, 1044 wire passing member, 106 hinge assembly, 1060 first connection member, 1061 second connection member, 1062 rotation shaft, 1063 tightening member, 1064 damping member, 1065 spacer, 108 support structure, 110 drive shaft, 112 horizontal position, 114 first position, 116 second position, and 118 fixation member.

DETAILED DESCRIPTION OF THE EMBODIMENTS

In order that the above-mentioned objectives, features and advantages of the present disclosure can be understood more clearly, a further detailed description of the present disclosure will be given below in connection with the accompanying drawings and specific embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure can also be implemented in other manners than those described herein. Therefore, the protection scope of the present disclosure is not limited to the specific embodiments disclosed below.

A fan 100 proposed according to some embodiments of the present disclosure is described below with reference to FIGS. 2 to 4.

Embodiment 1

As shown in FIG. 2, according to an embodiment of the present disclosure, the present disclosure proposes a fan 100, comprising: a column assembly 102, a fan head 104, a hinge assembly 106, and a support structure 108.

Specifically, the hinge assembly 106 comprises a first connection member 1060 and a second connection member 1061 which are hinge-connected to each other, the first connection member 1060 is connected to the column assembly 102, and the second connection member 1061 is connected to the fan head 104; and the support structure 108 is connected to the fan head 104 and the column assembly 102, wherein the fan head 104 is adapted to rotate around the support structure 108, and an axis around which the fan head 104 rotates relative to the support structure 108 coincides with an axis around which the first connection member 1060 and the second connection member 1061 rotate relative to each other.

The fan 100 provided in the present disclosure comprises a column assembly 102 and a fan head 104, the fan head 104 and the column assembly 102 are connected by a hinge assembly 106 and a support structure 108, wherein a first connection member 1060 and a second connection member 1061 of the hinge assembly 106 are hinge-connected to each other, i.e., the first connection member 1060 and the second connection member 1061 can rotate relative to each other, the fan head 104 is adapted to rotate around the support structure 108, and an axis around which the fan head 104 rotates around the support structure 108 coincides with an axis around which the first connection member 1060 and the second connection member 1061 rotate relative to each other, so that the fan head 104 can rotate around the axis around which the first connection member 1060 and the second connection member 1061 rotate relative to each other, i.e., the fan head 104 can rotate around the column assembly 102, thereby realizing adjustment of an air outlet angle of the fan head 104. Further, the support structure 108 connects the fan head 104 and the column assembly 102, which improves the reliability of connection between the fan head 104 and the column assembly 102, and also enables the fan 100 to have a better appearance, and therefore improves use experience of the user.

Specifically, the hinge assembly 106 comprises a first connection member 1060 and a second connection member 1061 which are hinge-connected to each other. The first connection member 1060 and the second connection member 1061 respectively connect the fan head 104 and the column assembly 102 so that the fan head 104 can rotate around the column assembly 102.

Moreover, the fan head 104 and the column assembly 102 are also connected by the support structure 108. On the one hand, the axis around which the fan head 104 rotates around the support structure 108 coincides with the axis around which the first connection member 1060 and the second connection member 1061 rotate relative to each other, so that the fan head 104 and the column assembly 102 can still rotate under the connection by the two structures, i.e., the hinge assembly 106 and the support structure 108; and on the other hand, the support structure 108 connects the fan head 104 and the column assembly 102, so that when the hinge assembly 106 fails, the fan head 104 and the column assembly 102 can still be connected by the support structure 108 to prevent the fan head 104 from falling, which improves the strength of connection between the fan head 104 and the column assembly 102 and increases the reliability of the fan 100, and also, when the fan head 104 is adjusted to a certain angle, the fan head 104 can be supported by the support structure 108, ensuring the reliability of the fan head 104.

Specifically, the support structure 108 may be ring-shaped, such that the center of circle of the support structure 108 coincides with the axis around which the first connection member 1060 and the second connection member 1061 rotate relative to each other.

Embodiment 2

An embodiment according to the present disclosure includes the features defined in the above embodiment, and further, the axis around which the first connection member 1060 and the second connection member 1061 rotate relative to each other is perpendicular to a length direction of the column assembly 102.

In this embodiment, the axis around which the first connection member 1060 and the second connection member 1061 rotate relative to each other is perpendicular to the length direction of the column assembly 102, thus realizing adjustment of an angle of depression and an angle of elevation of the fan head 104, thereby expanding an air outlet area of the fan 100.

Specifically, since the axis around which the fan head 104 rotates around the support structure 108 coincides with the axis around which the first connection member 1060 and the second connection member 1061 rotate, the axis around which the fan head 104 rotates around the support structure 108 is also perpendicular to the length direction of the column assembly 102.

Specifically, the fan 100 may be a floor fan, and therefore the column assembly 102 is placed in a vertical direction, i.e., the length direction of the column assembly 102 is the vertical direction.

Of course, the axis around which the first connection member 1060 and the second connection member 1061 rotate relative to each other can also be parallel to the column assembly 102, so that the rotation action of left-right head shaking of the fan head 104 can be achieved.

Embodiment 3

As shown in FIGS. 3 and 4, an embodiment according to the present disclosure includes the features defined in the above embodiments, and further, the fan 100 further comprises: a limit member provided at the fan head 104 and/or the column assembly 102, wherein the limit member is adapted to limit rotation of the fan head 104 between a first position 114 and a second position 116.

In this embodiment, the fan 100 further comprises a limit member, and by providing the limit member, the range of rotation of the fan head 104 can be limited, such that the fan head 104 rotates between the first position 114 and the second position 116.

Specifically, the limit member may be provided at the fan head 104 or on the column assembly 102. Of course, both the fan head 104 and the column assembly 102 can be provided with the limit member.

Specifically, during the rotation of the fan head 104, the angle of rotation of the fan head 104 can be limited by the limit member resisting the fan head 104 or the column assembly 102.

Further, an angle by which the fan head 104 rotates from a horizontal position 112 towards below the fan 100 to the first position 114 is greater than or equal to 0° and smaller than or equal to 6°, and an angle by which the fan head 104 rotates from the horizontal position 112 towards above the fan 100 to the second position 116 is greater than or equal to 0° and smaller than or equal to 90°, wherein the horizontal position 112 is between the first position 114 and the second position 116, the fan head 104 comprises a drive shaft 110 and fan blades connected to the drive shaft 110, and when the fan head 104 is located at the horizontal position 112, an axis of the drive shaft 110 is perpendicular to the length direction of the column assembly 102.

In this embodiment, as shown in FIGS. 3 and 4, the horizontal position 112 is between the first position 114 and the second position 116, and the fan head 104 can move from the horizontal position 112 to the first position 114 and the second position 116 respectively. When the fan head 104 is in the horizontal position 112, the axis of the drive shaft 110 is perpendicular to the length direction of the column assembly 102. That is, when the fan head 104 is in the horizontal position 112, the air outlet direction of the fan 100 is horizontal or approximately horizontal. The adjustment of the angle of depression and the angle of elevation of the fan head 104 can be realized through the hinge assembly 106 and the support structure 108. FIG. 3 is a schematic diagram when the fan head 104 moves to the first position 114. The angle by which the fan head 104 rotates from the horizontal position 112 towards below the fan 100 to the first position 114 is greater than or equal to 0° and smaller than or equal to 6°, i.e., the angle of depression of the fan head 104 moving downward from the horizontal position 112 is greater than or equal to 0° and smaller than or equal to 6°. FIG. 4 is a schematic diagram when the fan head 104 moves to the second position 116. The angle by which the fan head 104 rotates from the horizontal position 112 towards above the fan 100 to the second position 116 is greater than or equal to 0° and smaller than or equal to 90°, i.e., the angle of elevation of the fan head 104 moving upward from the horizontal position 112 is greater than or equal to 0° and smaller than or equal to 90°. That is, the fan head 104 can achieve an angle of depression of 6° and an angle of elevation of 90°, which expands the blowing range of the fan 100.

Specifically, the first position 114 is below the horizontal position 112 and the second position 116 is above the horizontal position 112.

Specifically, the fan 100 comprises a motor, and the motor is provided with a drive shaft 110 connected to the fan blades.

Further, the limit member on the fan head 104 is arranged at one side of the fan head 104 close to the support structure 108, and the limit member on the column assembly 102 is arranged at one side of the column assembly 102 close to the support structure 108.

In this embodiment, the limit member is arranged close to the support structure 108, so that the angle of rotation of the hinge assembly 106 can be limited at one side of the support structure 108.

Embodiment 4

As shown in FIG. 2, an embodiment according to the present disclosure includes the features defined in the above embodiments, and further, the hinge assembly 106 further comprises: a rotation shaft 1062 at which the first connection member 1060 and the second connection member 1061 are arranged, the second connection member 1061 being adapted to rotate around the rotation shaft 1062, wherein in an axis direction of the rotation shaft 1062, the second connection member 1061 is arranged at one side of the first connection member 1060; and an adjustment member connected to the rotation shaft 1062 and adapted to press the second connection member 1061 in the axis direction of the rotation shaft 1062.

In this embodiment, the hinge assembly 106 further comprises a rotation shaft 1062 and an adjustment member, and in the axis direction of the rotation shaft 1062, the second connection member 1061 is located at one side of the first connection member 1060, that is, the second connection member 1061 is located at the outer side of the first connection member 1060, so that the first connection member 1060 and the second connection member 1061 can be sequentially mounted at the rotation shaft 1062, which improves the assembly efficiency of the product and enhances the reliability of the product. Moreover, the first connection member 1060 can avoid the second connection member 1061 when the second connection member 1061 rotates, thus enabling the second connection member 1061 to have a greater angle of rotation to meet different use scenarios. The hinge assembly 106 further comprises an adjustment member connected to the rotation shaft 1062 and adapted to press the second connection member 1061 in the axis direction of the rotation shaft 1062, thus adjusting the axial pressure on the second connection member 1061 to improve the reliability of the hinge assembly 106.

Specifically, the adjustment member presses the second connection member 1061 in the axis direction of the rotation shaft 1062, and the magnitude of the axial pressure on the second connection member 1061 can be adjusted. The greater the axial pressure on the second connection member 1061, the greater the resistance to the rotation of the second connection member 1061, and thus the greater the force required to enable it to rotate around the rotation shaft 1062. Therefore, the magnitude of the force required to rotate the second connection member 1061 can be adjusted by the adjustment member. Further, by adjusting the axial pressure on the second connection member 1061, the friction between the second connection member 1061 and adjacent parts can be adjusted. That is, the greater the axial pressure on the second connection member 1061, the greater the friction between the second connection member 1061 and adjacent structures, and when the friction is able to counteract the force exerted on the second connection member 1061 that can cause it to rotate, the second connection member 1061 can be fixed in a designated position, so that the component connected to the second connection member 1061 is fixed in a designated position and will not rotate randomly, thereby improving the reliability of the hinge assembly 106. It may be understood that the resistance to the rotation of the second connection member 1061 includes the friction generated between the second connection member 1061 and the parts axially adjacent to the second connection member 1061.

Specifically, the first connection member 1060 and the second connection member 1061 can be sleeved sequentially on the rotation shaft 1062 in the direction of gravity, making the assembly convenient. Moreover, the distance between the first connection member 1060 and the second connection member 1061 in the axial direction of the rotation shaft 1062 can be adjusted at will, which improves the versatility of the hinge assembly 106.

Specifically, the first connection member 1060 can be rotated around the rotation shaft 1062, or the first connection member 1060 is fixed on the rotation shaft 1062.

Specifically, the first connection member 1060 is fixed on the rotation shaft 1062, and thus the rotation shaft 1062 can be fixed by the first connection member 1060.

Embodiment 5

As shown in FIG. 2, an embodiment according to the present disclosure includes the features defined in the above embodiments, and further, the adjustment member comprises: a tightening member 1063 located at one end of the rotation shaft 1062, the rotation shaft 1062 and the tightening member 1063 being each provided with a threaded structure, and the tightening member 1063 and the rotation shaft 1062 being threadedly connected by the threaded structure, wherein another end of the rotation shaft 1062 is further provided with a limiting structure 1066, and the first connection member 1060 and the second connection member 1061 are located between the limiting structure 1066 and the tightening member 1063.

In this embodiment, the adjustment member comprises a tightening member 1063, the rotation shaft 1062 is provided with a tightening member 1063 at one end and a limiting structure at another end, the first connection member 1060 and the second connection member 1061 are provided between the limiting structure and the tightening member 1063, and the squeezing force applied to the second connection member 1061 can be adjusted by the tightening member 1063, wherein both the tightening member 1063 and the rotation shaft 1062 are provided with a threaded structure, and the tightening member 1063 and the rotation shaft 1062 are threadedly connected by the threaded structure, so that the squeezing force applied by the tightening member 1063 to the second connection member 1061 is adjustable. Moreover, threaded connection is highly reliable, and when the tightening member 1063 is rotated to be removed from the rotation shaft 1062, the parts on the rotation shaft 1062 can be easily removed and replaced.

Specifically, the rotation shaft 1062 and the limiting structure provided at the end portion of the rotation shaft 1062 are a one-piece structure, the rotation shaft 1062 comprises a bolt or a screw, and the tightening member 1063 comprises a nut.

Further, the adjustment member further comprises: a damping member 1064 connected to the rotation shaft 1062, the damping member 1064 being arranged between the first connection member 1060 and the tightening member 1063, and/or between the second connection member 1061 and the first connection member 1060.

In this embodiment, the adjustment member further comprises a damping member 1064 connected to the rotation shaft 1062. The damping member 1064 can increase the resistance to the rotation of the second connection member 1061, so that the friction generated by the rotation of the second connection member 1061 is increased, and the force required to rotate the second connection member 1061 will also increase, thereby improving the stability of the hinge assembly 106. The damping member 1064 may be selectively arranged between the first connection member 1060 and the tightening member 1063 and between the second connection member 1061 and the first connection member 1060.

Specifically, the magnitude of the force required to rotate the second connection member 1061 may be adjusted by adding or reducing the damping member 1064. For example, it is feasible to increase the resistance to rotation of the second connection member 1061 by adding the damping member 1064, when the tightening member 1063 is screwed in the same position as the rotation shaft 1062, thereby increasing the force required to rotate the second connection member 1061, i.e., a greater force is required to rotate the second connection member. When the resistance to the rotation of the second connection member 1061 is greater than or equal to the force applied by another structure or a person to the second connection member 1061, the hinge assembly 106 can be kept in its current state, i.e., the second connection member 1061 is kept immobile, improving the stability of the hinge assembly 106.

Specifically, other structures than the hinge assembly 106 may be connected to the second connection member 1061. Said other structures include the fan head 104 of the fan 100 or the column assembly 102 of the fan 100, and may exert a force on the second connection member 1061 in the direction of rotation of the second connection member 1061. When the resistance to the rotation of the second connection member 1061 is greater than or equal to the force exerted by said other structures on the second connection member 1061, the hinge assembly 106 and said other structures mounted at the second connection member 1061 can be kept in their current state, thereby improving the stability of the second connection member 1061 and said other structures connected to the second connection member 1061.

Further, the damping member 1064 is a resilient pad, making it possible to adjust the force required to rotate the second connection member 1061.

Further, the adjustment member further comprises: a spacer 1065 connected to the rotation shaft 1062, the spacer 1065 being arranged between the second connection member 1061 and the limiting structure, and/or between the first connection member 1060 and the second connection member 1061, and/or between the first connection member 1060 and the tightening member 1063.

In this embodiment, the adjustment member further comprises a spacer 1065 which may be provided between two structures to improve the stability of connection. The spacer 1065 is arranged between the second connection member 1061 and the limiting structure, and/or between the second connection member 1061 and the first connection member 1060, and/or between the first connection member 1060 and the tightening member 1063. Moreover, the position and number of spacers 1065 and damping members 1064 may be set at will in the present disclosure, while the position and number of spacers are limited by the distance between two connection walls in the related art.

Specifically, in the axial direction of the rotation shaft 1062, the two ends of the spacer 1065 abut against other structures, that is, the spacer 1065 can press the structures on both sides, thus increasing the force required to rotate the structures on both sides of the spacer 1065, improving the stability of the hinge assembly 106.

Embodiment 6

An embodiment according to the present disclosure includes the features defined in the above embodiments, and further, in the axis direction of the rotation shaft 1062, at least a portion of the rotation shaft 1062 is formed with a limit surface; the spacer 1065 is provided with a through hole, and a shape of a cross section of the through hole matches a shape of a cross section of the portion of the rotation shaft 1062 provided with the limit surface.

In this embodiment, in the axis direction of the rotation shaft 1062, the rotation shaft 1062 is formed with a limit surface, and the shape of the section of the through hole of the spacer 1065 is adapted to the shape of the portion of the rotation shaft 1062 provided with the limit surface, so that the spacer 1065 cannot be rotated along the rotation shaft 1062, thus improving the stability of the hinge assembly 106.

Specifically, the parts of the rotation shaft 1062 that are connected to other structures than the second connection member 1061 and the tightening member 1063 on the hinge assembly 106 may all be provided with a limit surface correspondingly, and the shape of a mounting hole part where said other structures than the second connection member 1061 and the tightening member 1063 are connected to the rotation shaft 1062 is also adapted to the rotation shaft 1062, thus preventing said other structures from rotating, and improving the reliability of the structure.

Further, the number of limit surfaces is at least two, and in a circumferential direction of the axis of the rotation shaft 1062, the at least two limit surfaces are provided opposite each other.

In this embodiment, in the circumferential direction of the axis of the rotation shaft 1062, at least two limit surfaces are provided opposite each other, which improves the limiting effect of the limit surfaces.

Embodiment 7

As shown in FIG. 2, an embodiment according to the present disclosure includes the features defined in any of the above embodiments, and further, the support structure 108 is ring-shaped.

In this embodiment, the support structure 108 is ring-shaped, thus facilitating the rotation of the fan head 104 around the support structure 108, and further, the hollow portion of the ring-shaped structure also allows wires to pass through, making the wiring of the fan 100 more reasonable and saving the space occupied by the fan 100.

Further, the support structure 108 comprises a rubber support structure.

In this embodiment, the support structure 108 comprises a rubber support structure. The rubber support structure has a certain friction and has a certain wear resistance, and thus can improve the stability of the fan head 104 when rotating.

Specifically, the support structure 108 is a wear ring.

Embodiment 8

An embodiment according to the present disclosure includes the features defined in any of the above embodiments, and further, the column assembly 102 comprises: a column; a first mounting member 201 provided at the column, at least a portion of the support structure 108 being accommodated in the first mounting member 201; and a second mounting member 202, at least a portion of the hinge assembly 106 being accommodated in the second mounting member 202, wherein the first mounting member 201 and the second mounting member 202 are located at two opposite sides of the column.

In this embodiment, the column assembly 102 comprises a column, a first mounting member and a second mounting member, wherein the support structure 108 is provided in the first mounting member, the support structure 108 is supported and pre-mounted by the first mounting member, the hinge assembly 106 is accommodated in the second mounting member, and the hinge assembly 106 can be pre-mounted by the second mounting member, i.e., at the time of connecting the hinge assembly 106 to the column assembly 102, it is feasible to first place the hinge assembly 106 in the second mounting member, thus facilitating the mounting of the hinge assembly 106.

The first mounting member and the second mounting member are located at two opposite sides of the column, which improves the strength of the connection between the fan head 104 and the column assembly 102.

Embodiment 9

As shown in FIG. 2, an embodiment according to the present disclosure includes the features defined in any of the above embodiments, and the fan head 104 comprises: a housing, a first connection member 1060 being connected to the housing, and a motor of the fan head 104 being located in the housing; a first limit part 1040 provided at the housing, the first limit part 1040 being connected to the support structure 108, and the first limit part 1040 being adapted to rotate around the support structure 108; and a second limit part 1042 provided at the housing, the second limit part 1042 being connected to the column, and the support structure 108 being clamped between the second limit part 1042 and the column, wherein the fan 100 further comprises a fixation member 118, and the second limit part 1042 is hinged to the column through the fixation member 118.

In this embodiment, the fan head 104 comprises a housing, a first limit part 1040, and a second limit part 1042, wherein the motor of the fan 100 is provided in the housing, and the drive shaft 110 of the motor drives the fan blades to rotate to exhaust air to the environment. The first limit part 1040 is connected to the support structure 108, the second limit part 1042 is connected to the column, and the support structure 108 is clamped between the column and the second limit part 1042, thus limiting the support structure 108.

Specifically, the second limit part 1042 and the column are rotatable relative to each other, and the axis of rotation coincides with the axis of the rotation shaft 1062.

Further, as shown in FIG. 2, the first limit part 1040 comprises a limiting groove, the support structure 108 being engaged in the limiting groove.

In this embodiment, the first limit part 1042 comprises a limiting groove, and engaging the support structure 108 in the limiting groove improves the connection strength on the one hand, and facilitates the detachment of the support structure 108 on the other hand.

Specifically, the downward-facing side of the limiting groove is closed, and the ring-shaped support structure 108 is engaged in the limiting groove, thereby supporting the support structure 108 through the downward-facing side wall of the limiting groove to prevent the support structure 108 from detaching from the fan head 104.

Further, the second limit part 1042 is provided with a wire passing member 1044, wherein the fan 100 further comprises a connection wire, and the connection wire is connected to the fan head 104 from the column assembly 102 through the wire passing member 1044.

In this embodiment, the second limit part 1042 is hollowed out, so that wires can be passed through the hollowed-out wire passing member 1044, and therefore the adjustment of the angle of depression and the angle of elevation of the fan head 104 will not be limited by the connection wire.

Further, an outer side wall of the second limiting section 1042 is arc-shaped.

In this embodiment, the outer side wall of the second limit part 1042 is arc-shaped, so as to be adapted to the shape of the support structure 108, ensuring the clamping effect on the support structure 108, and also ensuring the reliability of the rotation of the fan head 104.

Embodiment 10

According to a specific embodiment of the present disclosure, as shown in FIG. 2, the fan 100 comprises a column assembly 102 and a fan head 104. The left side of the column assembly 102 connects the fan head 104 to the column assembly 102 by a wear ring, the right side of the column assembly 102 connects the fan head 104 to the column assembly 102 by a hinge assembly 106, the angle of depression and the angle of elevation of the fan head 104 are limited by providing a limit member 203 at one side of the fan head 104 and/or the column assembly 102 close to the wear ring, and further, the fan head 104 also presses the wear ring on to the column by the second limit part 1042 and the fixation member 118, so that the stability and reliability of the adjustment of the angle of depression and the angle of elevation of the fan head 104 are ensured by the friction caused by the pressing at the wear ring and the resistance when the hinge assembly 106 is rotated. As shown in FIG. 3 and FIG. 4, the fan head 104 can achieve a maximum angle of depression of 6° and a maximum angle of elevation of 90°, and can be adjusted arbitrarily between the maximum angle of depression and the maximum angle of elevation.

Further, at the wear ring, the degree of clamping of the wear ring by the second limit part 1042 is adjustable by means of the fixation member 118, and furthermore, the fixation member 118 is a bolt.

Further, on the hinge assembly 106, the resistance to rotation of the first connection member 1060 and the second connection member 1061 relative to each other is adjustable by means of the rotation shaft 1062 and the adjustment member.

Further, the opposing sides of the rotation shaft 1062 are provided with a limit surface, and a through hole of the spacer 1065 is adapted to the shape of the portion provided with the limit surface, which can prevent the tightening member 1063 from loosening. Specifically, the through hole of the spacer 1065 is U-shaped.

Specifically, the second limit part 1042 is provided with a wire passing member 1044. Specifically, the wire passing member 1044 is in a hollow shape, making it convenient and reliable to pass wires through the wire passing member 1044.

In the present disclosure, the term "a plurality of" means two or more, unless otherwise explicitly defined. The terms "mounting," "connected," "connection," "fixing" and the like should be understood in a broad sense, for example, "connection" may be a fixed connection, and may also be a removable connection, or an integral connection; and "connected" may refer to direct connection and may also refer to indirect connection through an intermediary. A person of ordinary skills in the art could understand the specific meaning of the terms in the present disclosure according to specific situations.

In the description of the present specification, the descriptions of the terms "one embodiment," "some embodiments" and "specific embodiments" and the like mean that specific features, structures, materials or characteristics described in conjunction with the embodiment(s) or example(s) are included in at least one embodiment or example of the present disclosure. In the specification, the schematic representation of the above terms does not necessarily refer to the same embodiment or example. Moreover, the particular features, structures, materials or characteristics described may be combined in a suitable manner in any one or more embodiments or examples.

The descriptions above are only preferred embodiments of the present disclosure, which are not used to limit the present disclosure. For a person skilled in the art, the present disclosure may have various changes and variations. Any modifications, equivalent substitutions, improvements etc. within the spirit and principle of the present disclosure shall all be included in the protection scope of the present disclosure.

What is claimed is:

1. A fan comprising:

a column assembly;

a fan head;

a hinge assembly including a first member and a second member which are hinge-connected to each other, the first member being connected to the column assembly, and the second member being connected to the fan head; and a support structure connected to the fan head and the column assembly;

wherein:

the fan head is configured to rotate around the support structure, and an axis around which the fan head rotates relative to the support structure coincides with an axis around which the first member and the second member rotate relative to each other; and the fan head includes:

a housing, the first member being connected to the housing, and a motor of the fan head being located in the housing;

a first limit part provided at the housing, the first limit part being connected to the support structure, and the first limit part being configured to rotate around the support structure; and a second limit part provided at the housing, the second limit part being connected to the column assembly, and the support structure being clamped between the second limit part and the column assembly.

2. The fan according to claim 1, wherein the axis around which the first member and the second member rotate relative to each other is perpendicular to a length direction of the column assembly.

3. The fan according to claim 2, further comprising:

a limit member provided at the fan head or the column assembly, and configured to limit rotation of the fan head between a first position and a second position.

4. The fan according to claim 3, wherein:

the first position is below the fan and an angle by which the fan head rotates from a horizontal position to the first position is greater than or equal to 0° and smaller than or equal to 6°;

the second position is above the fan and an angle by which the fan head rotates from the horizontal position to the second position is greater than or equal to 0° and smaller than or equal to 90°;

the horizontal position is between the first position and the second position;

the fan head includes a drive shaft and fan blades connected to the drive shaft, and when the fan head is located at the horizontal position, an axis of the drive shaft is perpendicular to the length direction of the column assembly.

5. The fan according to claim 3, wherein the limit member is provided at the fan head and is arranged at one side of the fan head close to the support structure.

6. The fan according to claim 3, wherein the limit member is provided at the column assembly and is arranged at one side of the column assembly close to the support structure.

7. The fan according to claim 2, wherein the hinge assembly further includes:

a rotation shaft at which the first member and the second member are arranged, the second member being configured to rotate around the rotation shaft, and in an axis direction of the rotation shaft, the second member being arranged at one side of the first member; and an adjustment member connected to the rotation shaft and configured to press the second member in the axis direction of the rotation shaft.

8. The fan according to claim 7, wherein:

the adjustment member includes a tightening member located at one end of the rotation shaft, and being threadedly connected to the rotation shaft via threaded structures provided at the tightening member and the rotation shaft;

another end of the rotation shaft is provided with a limiting structure; and the first member and the second member are located between the limiting structure and the tightening member.

9. The fan according to claim 8, wherein the adjustment member further includes:

a damping member connected to the rotation shaft, the damping member being arranged between the first member and the tightening member, or between the second member and the first member; and a spacer connected to the rotation shaft, the spacer being arranged between the second member and the limiting structure, between the first member and the second member, or between the first member and the tightening member.

10. The fan according to claim 9, wherein in the axis direction of the rotation shaft, at least a portion of the rotation shaft is formed with a limit surface; and the spacer is provided with a through hole, and a shape of a cross section of the through hole matches a shape of a cross section of the portion of the rotation shaft provided with the limit surface.

11. The fan according to claim 10, wherein:

the limit surface is one of at least two limit surfaces; and in a circumferential direction of the axis of the rotation shaft, the at least two limit surfaces are provided opposite each other.

12. The fan according to claim 10, wherein the damping member includes a resilient pad.

13. The fan according to claim 1, wherein the support structure is ring-shaped.

14. The fan according to claim 1, wherein the support structure includes a rubber support structure.

15. The fan according to claim 1, wherein the column assembly includes:

a column;

a first mounting provided at a first side of the column, at least a portion of the support structure being accommodated in the first mounting; and a second mounting provided at a second side of the column opposite to the first side, at least a portion of the hinge assembly being accommodated in the second mounting.

16. The fan according to claim 1, further comprising:

a fixation member wherein the second limit part is hinged to the column through the fixation member.

17. The fan according to claim 1, wherein the first limit part includes a limiting groove, and the support structure is engaged in the limiting groove.

18. The fan according to claim 1, further comprising:

a connection wire;

wherein the second limit part is provided with a wire passing member, and the connection wire is connected to the fan head from the column assembly through the wire passing member.

19. The fan according to claim 1, wherein an outer side wall of the second limit part is arc-shaped.

20. A fan comprising:

a column assembly;

a fan head;

a hinge assembly including a first member and a second member which are hinge-connected to each other, the first member being connected to the column assembly, and the second member being connected to the fan head; and a support structure connected to the fan head and the column assembly;

wherein:

the fan head is configured to rotate around the support structure, and an axis around which the fan head rotates relative to the support structure coincides with an axis around which the first member and the second member rotate relative to each other; and the column assembly includes:

a column;

a first mounting provided at a first side of the column, at least a portion of the support structure being accommodated in the first mounting; and a second mounting provided at a second side of the column opposite to the first side, at least a portion of the hinge assembly being accommodated in the second mounting.

* * * * *